US008529412B2

(12) United States Patent
Reade

(10) Patent No.: US 8,529,412 B2
(45) Date of Patent: Sep. 10, 2013

(54) OMNI-DIRECTIONAL EXERCISE DEVICE

(75) Inventor: Catherine Reade, Highlands Ranch, CO (US)

(73) Assignee: Resistance Dynamics, Highlands Ranch, CO (US)

( * ) Notice: Subject to any disclaimer, the term of this patent is extended or adjusted under 35 U.S.C. 154(b) by 0 days.

(21) Appl. No.: 13/526,292

(22) Filed: Jun. 18, 2012

(65) Prior Publication Data

US 2012/0252644 A1 Oct. 4, 2012

Related U.S. Application Data

(63) Continuation-in-part of application No. 12/703,059, filed on Feb. 9, 2010, now Pat. No. 8,202,205.

(51) Int. Cl.
*A63B 21/00* (2006.01)

(52) U.S. Cl.
USPC ..... 482/79; 482/80; 482/44; 482/121; 482/123

(58) Field of Classification Search
USPC ..... 482/79, 80, 49, 126, 129
See application file for complete search history.

(56) References Cited

U.S. PATENT DOCUMENTS

| | | | |
|---|---|---|---|
| 2,760,774 | A | 8/1956 | Perez |
| 5,921,900 | A | 7/1999 | Mankovitz |
| 5,957,816 | A | 9/1999 | Staffa |
| 6,277,057 | B1 | 8/2001 | Hayden |
| 6,283,897 | B1 | 9/2001 | Patton |
| 6,821,235 | B1 | 11/2004 | Johnson et al. |
| 6,935,991 | B1 | 8/2005 | Mangino |
| 7,322,914 | B1 | 1/2008 | Vittone et al. |
| 2004/0035025 | A1 | 2/2004 | Choi |

*Primary Examiner* — Jerome W Donnelly
(74) *Attorney, Agent, or Firm* — Perkins Coie LLP

(57) ABSTRACT

This disclosure describes, generally, an omni-directional exercise device. The device includes a platform base and resistance bands coupled to the platform base. The device further includes one or more enclosures coupled to the plurality of resistance bands. The one or more enclosures are positioned on top of the platform base at a home position. The one or more enclosures are configured to slide on top of the platform base in a 360-degree range of motion such that the plurality of resistance bands provide resistance at any point on the platform base and are configured to return to the home position.

20 Claims, 20 Drawing Sheets

OMNI-DIRECTIONAL EXERCISE DEVICE

CROSS-REFERENCE TO RELATED APPLICATION

This application is a continuation-in-part of U.S. patent application Ser. No. 12/703,059 which was filed on Feb. 9, 2010 entitled "Omni-Directional Exercise Device," the entire contents of which is hereby incorporated herein by reference for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD OF THE INVENTION

Various embodiments of the present invention generally relate to exercise devices and, more particularly, to an omni-directional exercise device.

BACKGROUND

Societies today live a high-tech, sedentary lifestyle with little or no time for exercise. A large majority of the world's population spends time in front of computers (or other electronic devices) to perform work or personal tasks on a daily basis. Workers share a significant dependence on computers to efficiently and effectively expedite their work. This has created work and home environments where long hours are spent sitting in front of a computer or at a desk. As a result, health has suffered as evidenced by the rise of chronic lifestyle conditions like heart disease, obesity, and diabetes. Health experts agree that more activity should be introduced into sedentary lifestyles for better health.

Attempting to find time to exercise can add stress to an already over-stressed schedule of work, family, and community commitments. It is often impossible to get away from the workplace to exercise. Office workers and others may be left with sluggish metabolisms, lethargy, and general discomfort and, as a result, may exhibit poor productivity. Long hours at the computer are becoming more prevalent. Worldwide, it is estimated that half of the workforce from developed countries will be working at computers. Accordingly, people need an exercise device that is convenient, effective, inexpensive and easy to use, without any extra time investment required. A device is needed for a user to utilize whenever desired while the user simultaneously performs office work like talking on the phone, answering emails, searching the internet, doing research, writing documents, reading or other myriad office tasks. Hence, improvements in the art are needed.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sub-label is associated with a reference numeral to denote one of multiple similar components. When reference is made to a reference numeral without specification to an existing sub-label, it is intended to refer to all such multiple similar components.

Figure 1:
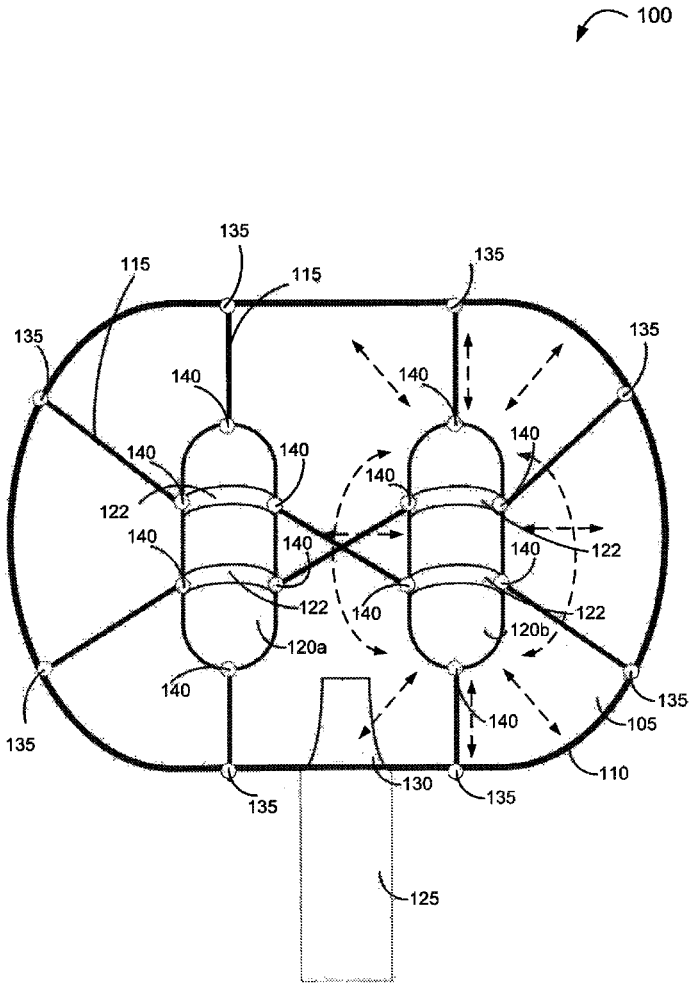
FIG. 1 is a block diagram illustrating a top-view of an omni-directional exercise device, in accordance with one embodiment of the present invention.

The drawings have not necessarily been drawn to scale. For example, the dimensions of some of the elements in the figures may be expanded or reduced to help improve the understanding of the embodiments of the present invention. Similarly, some components and/or operations may be separated into different blocks or combined into a single block for the purposes of discussion of some of the embodiments of the present invention. Moreover, while the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

SUMMARY

This disclosure describes, generally, an omni-directional exercise device. The device includes a platform base and resistance bands coupled to the platform base. The device further includes one or more enclosures (e.g., a foot enclosure or a hand enclosure) coupled to the plurality of resistance bands. In one embodiment, the enclosure(s) and the platform base include a plurality of notches at different locations (e.g., along the perimeter and/or interior) to allow for more specific muscular targeting and resistance levels. Still yet, some embodiments of the platform base allow for a top with differing contoured and flat sections. The one or more enclosures are positioned on top of the platform base at a home position. The one or more enclosures may be configured to slide on top of the platform base in a 360-degree range of motion such that the plurality of resistance bands provide resistance at any point on the platform base and are configured to return to the home position. In some embodiments, the enclosures can be lifted away from the platform base with the resistance bands or other resistance mechanism (e.g., magnetic fields) providing resistance. Still yet, the enclosures may be able to rotate, slide, or move along or about one or more axes to provide additional resisted movements.

DETAILED DESCRIPTION

While various aspects of embodiments of the invention have been summarized above, the following detailed description illustrates exemplary embodiments in further detail to enable one of skill in the art to practice the invention. In the following description, for the purposes of explanation, numerous specific details are set forth in order to provide a thorough understanding of the present invention. It will be apparent, however, to one skilled in the art that the present invention may be practiced without some of these specific details. In other instances, well-known structures and devices are shown in block diagram form. Several embodiments of the invention are described below and, while various features are ascribed to different embodiments, it should be appreciated that the features described with respect to one embodiment may be incorporated with another embodiment as well. By the same token, however, no single feature or features of any described embodiment should be considered essential to the invention, as other embodiments of the invention may omit such features.

Aspects of the present invention relate to an omni-directional exercise device that provides isometric and/or dynamic activity for a user while seated and simultaneously working at a computer, desk, or the like. The device can be used for toning, strengthening, rehabilitation, etc. of a wide range of muscles of the lower body (e.g. the feet, ankles, shins, calves, knees, quadriceps, hamstrings, inner and outer thighs, gluteus, hips, etc.) and/or the upper body (e.g., the arms, biceps, triceps, pectorals, etc.). In one embodiment, the exercise device may include a platform with one or more foot/hand enclosures in the center with elastic-type bands that attach from the foot/hand enclosures to the platform in order to provide resistance. The platform may have a small notch in the center of the lower part of the platform to receive one leg and caster of, for example, an office chair so that the device sits conveniently at the user's feet. In some embodiments, one or more resistance bands can be connected (e.g., along the perimeter of the platform base) allowing the user to perform upper body exercises.

The foot/hand enclosures may be attached to the platform and connected to one another with elastic-type resistance bands in a unique configuration that provides for 360 degrees of omni-directional movement patterns where the exercises performed can be isometric, dynamic, or both. One band may attach from each toe and heel portion; two bands may attach from each lateral part of the foot enclosures with center bands in an "X" configuration that connect the right and left foot enclosures to each other, thus, providing for a unique feel and resistive force. The bands can be adjusted in length and thickness to provide different levels of resistance to meet the preferences and varying needs of the user. The platform may be constructed of a smooth, low-friction surface that provides a quiet slide of the foot enclosures over the platform.

Furthermore, users can move the enclosures (e.g., with their feet) in virtually limitless omni-directional patterns. Patterns performed may include, but are not limited to, forward and back movements (knee flexion and extension); lateral out and in moves (leg abduction and adduction); circular clockwise and counterclockwise moves for the inner and outer thighs, plus hips and gluteal muscles; heel and toe raises for the calves and shins respectively; pivoting foot motions to strengthen various muscles of the ankles; and many more combinations thereof. In some cases, target indicators may be placed on the platform base to aid in providing the user with a set of directed movements. The target indicators may be active or static. For example, in some embodiments, the target indicators may include lights, symbols, numbers, letters, lines, patterns, along with other visual aids.

By altering the position or angle of the feet during the exercises, the user can activate different muscles. In addition, exercises can be performed isometrically, dynamically, or both at the same time. For example, inner thighs can be strengthened isometrically by performing leg adduction and holding the inner thighs together for a period of time, while the inner thighs can be dynamically activated with lateral motions going to the outside of the platform and then sliding inwards. A combination of both isometric and dynamic activity can be done when the thighs are brought together and held as in isometric leg adduction and then adding a dynamic movement of the feet sliding in a forward and backward motion (knee extension and flexion).

Furthermore, benefits of the present invention are that the device appeals to a broad range of users including those living a sedentary lifestyle to trained athletes. For those individuals who are overweight or obese, it is a great place to start exercising since it is easy to slip in and out of, is non-weight-bearing so no extra stress is placed on painful joints, and it conveniently sits at the user's feet so it can be used whenever desired and in the privacy of the user's office or home. For individuals who experience poor circulation or inflammation, the present invention helps improve these conditions. Peer-reviewed research indicates that exercise decreases inflammation and the corresponding pain that goes along with it. Athletes can use the device to supplement their training which may improve sports performance as it strengthens macro- and micro-muscles around joints, particularly ankles and knees. The device may also be used to rehabilitate injured muscles. The device is lightweight and portable, so it can be easily handled by anyone in the home, in the office, or for travel. In addition, the device can come in different sizes (e.g., sizes for children to very large adults) as well as designed for seated or standing use. For example, some embodiments of the device can include a post with a handle that would attach into the notch cut out for a standing version. In some standing models (e.g., for rehabilitation) balance and support bars can be built in or around the base. The device is inexpensive and versatile, providing isometric and/or dynamic activity where the user chooses the resistance and pace. Toning, strengthening or rehabilitation of the lower and/or upper body can be achieved safely from the comfort of a chair. The user will be burning more calories daily, resulting in weight loss or maintenance of a healthy weight. An energy boost both physically and mentally is also experienced. These positive effects will lead to an enhanced level of fitness with a concomitant quality of life improvement for the user. All of these health benefits without any extra time investment required make it perfect for anyone.

Turning now to FIG. 1, which illustrates an omni-directional exercise device 100, in accordance with one embodiment of the present invention. The device 100 may include a platform base 105. In one embodiment, platform base 105 may be constructed of a durable, low-friction, smooth material (e.g., a polymer plastic, wood, metal, stainless steel or other material to create as frictionless a surface as possible). Platform base 105 may be of sufficient thickness and weight to prevent movement of platform base 105, but light enough for easy portability. Further, platform base 105 may be flat and oval or semi-oval shaped; however, other suitable shapes may be used. Dimensions of platform base 105 may vary, for example, from 35 to 28 inches wide, 20 to 25 inches deep. These dimensions are approximate and may increase or decrease for this and/or other embodiments.

Platform base 105 may include a rounded edge 110 and attachment points 135 which may be configured to create less friction and/or stress on resistance bands 115, thus increasing longevity. In one embodiment, resistance bands 115 may be made from an elastic-type material which would provide resistance. Resistance bands 115 may attach from attachment points 140 on foot enclosures 120*a* and 120*b* to attachment points 135 on platform base 105. In a further embodiment, attachment points 140 on foot enclosures 120 may be positioned at the center of the heel and toe areas with two points on the outside areas and two points that crisscross in the center areas, thus attaching foot enclosure 120*a* to foot enclosure 120*b*.

The level of difficulty (or amount of resistance) can be adjusted by differing the length, thickness, and type of material of resistance bands 115. For example, the resistance of the bands can be adjusted to meet the varying and changing needs of the user. This may be achieved by variation in length and thickness of resistance bands 115, such that the longer and/or thinner the bands, the lighter the resistance, and conversely the shorter and/or heavier the bands, the higher the resistance. Tension can also be adjusted to meet the varying and changing needs of the user. Tension can be set at differing levels from lax to taut with lax being the easiest and taut being the more challenging tension. The resistance level of resistance bands 115 may gradually increase from extra light, light, moderate, challenging levels, and so forth of resistance based on the condition of the user. In one embodiment, equal tension for all bands is provided for smooth operation of the device. In one embodiment, resistance bands may be constructed from Polypropylene cord, latex cord, neoprene cord, or the like.

Furthermore, resistance bands 115 may be removed. For example, for unconditioned users, the toe and/or heel bands may not need to be used initially, thus making the movements much easier. When sufficient strength is gained, these bands can be attached for an additional muscular challenge and to achieve further strengthening of a wider range of lower body muscles. For example, a set of 10 bands may include: 2 toe; 2 heel; 4 lateral; and 2 center bands, and a pack of three sets of bands of graduated resistance may be included to meet the preferences and changing needs of the user. The lightest resistance bands may be the longest while the most challenging bands may be the shortest.

Figure 3A:
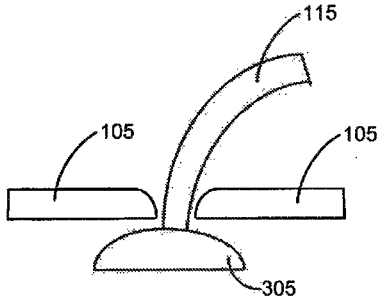
FIGS. 3A, 3B, and 3C are block diagrams illustrating foot enclosures, in accordance with one embodiment of the present invention.

In one embodiment, resistance bands 115 may have bulbous ends (see, for example, FIG. 3A, reference number 305) that may easily slide into attachment points 135 and 140 on foot enclosures 120*a* and 120*b* and platform base 105. Further, the slit in FIG. 3A may be in a semi-circular underside area cut out, and resistance band 115 may slide through the slit. The bulbous end 305 is then secured in the semi-circular opening.

Platform base 105 may further include a notch 130 at the center of platform base 105. Notch 130 may be configured to receive a chair base (not shown), or the like. In one embodiment, the interior portion of notch 130 may measure 2 to 4 inches and may be graduated from the exterior portion measuring between 3 to 5 inches, in order to receive the office chair caster. Nonetheless, the size and dimensions of notch 130 may be adjusted accordingly to accommodate various chair sizes and configurations. Device 100 may further include a guide 125. Guide 125 may be configured to guide a chair base into notch 130, in order to provide for easy seating of the chair.

In an alternative embodiment of the present invention, omni-directional device 100 may be placed on the user's lap or other flat surface, and foot enclosures 120 may alternatively be used as hand enclosures. Accordingly, the user may use the device in the same or similar way as used with the feet, but instead for working the upper body muscle groups.

In a further alternative embodiment, at guide 125, instead of sliding a chair base into omni-directional device 100, a handle and post may be used. For example, the user may stand on the device and use the handle and post for balance and support. Additionally, support and balance bars may be built into and around the base to perform for standing exercises in various embodiments.

Figure 2:
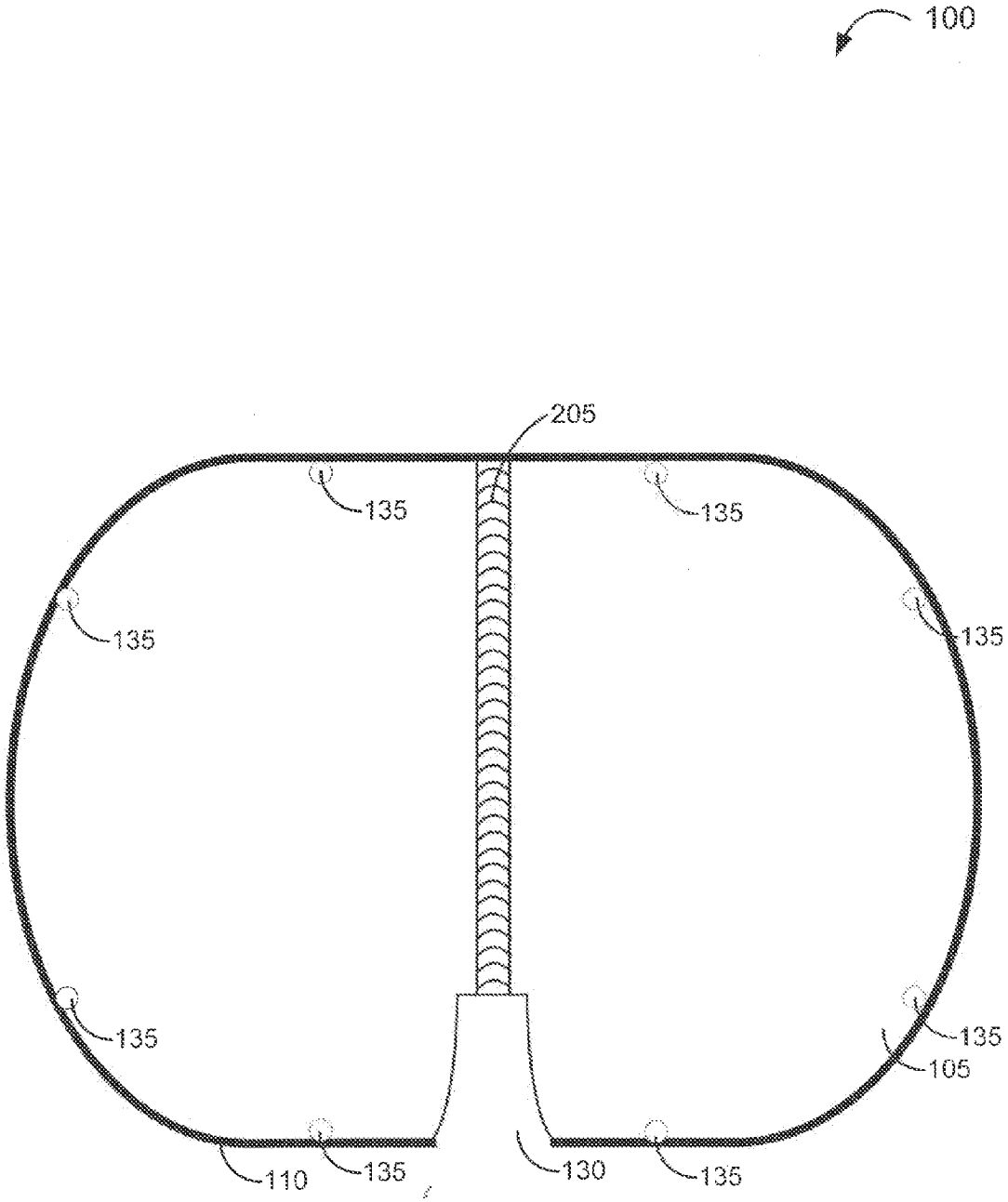
FIG. 2 is a block diagram illustrating a bottom-view of an omni-directional exercise device, in accordance with one embodiment of the present invention.

Turning now to FIG. 2, which illustrates the bottom portion of device 100 in accordance with aspects of the present invention. Platform base 105 may have center hinges 205, allowing platform base 105 to fold to half its size for travel use and greater portability. The underside of platform base 105 may have a rubber resistant coating to allow the device to grab the floor surface to prevent movement of the base. Alternatively, other adhesive or high gripping friction materials may be used to reduce or eliminate slipping of platform base 105. Furthermore, attachment points 135 for resistance bands 115 may be located on the underside of platform base 105.

Figure 3B:
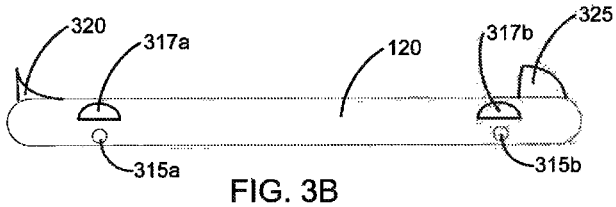
Figure 3C:
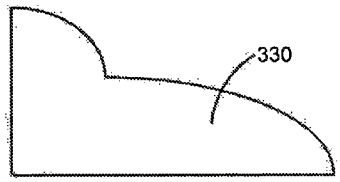

FIGS. 3B and 3C illustrate embodiments of foot enclosures 120*a* and 120*b*. In one embodiment, foot enclosures 120*a* and 120*b* may sit in the center of platform base 105 with resistance bands 115 attached in the center of the toe and heel areas; and two bands connected to the outside portion of each foot; and two center bands are crisscrossed effectively attaching the right and left shoes to each other. The length and tension of the band may vary with the type of elastic resistance band used, fitness level of the user and to a lesser extent, the size of the shoe. Further, the bigger the shoe, the shorter the band length becomes incrementally. The foot enclosure may come in small, medium and large sizes to accommodate different shoe sizes of the user. Each foot enclosure can be adjusted to the correct size for a custom, snug fit for each individual user. This can be achieved by a sliding mechanism found in the center of the foot bed that can be locked into place. The first size adjustment is all that will be needed prior to its use.

In one embodiment, foot enclosures 120 may be constructed from a durable material, like a polymer plastic, wood or wood derivative or other similar material. Adjustable straps 122, a heel cup 320, and toe receptacle 325 are provided to stabilize each foot and prevent wiggling within the enclosure for a smooth activity experience. Foot enclosures 120 also allow the user to simply slip in and out of an enclosure 330, without any adjustments required after the initial sizing and personal customization. For example, as shown in FIG. 3C, the bare foot, stocking foot, shoe, etc. may be completely (or nearly completely) enclosed in enclosure 330.

Furthermore, straps 122 may have Velcro-type attachment points or other adjustable means such that a snug fit around the foot is achieved. Foot enclosures 120 may also be configured to receive a flat shoe or a bare foot. For example, for users who prefer to use the device with a bare or a stocking foot, a slipper-type insert may also be used. The insert may be made from soft, cushioning materials (e.g., a gel, foam, etc.) that will provide an extremely comfortable fit.

In a further embodiment, the center resistance bands 115 may attach to the interior of foot enclosures 120 at the center point of the heel and mid-foot. The center band may be configured in a cross configuration (X) and provide a unique resistance when in motion. Resistance bands 115 on the exterior portion of foot enclosure 120 may be attached with attachment points 315*a*, 317*a* and 315*b*, 317*b*, which may line up with the center attachment points at the mid-heel and mid-foot. These bands may extend diagonally from the foot enclosure to the underside of platform base 105, where they attach by sliding the bulbous end 305 into a notched area and can provide varying resistance.

Figure 4A:
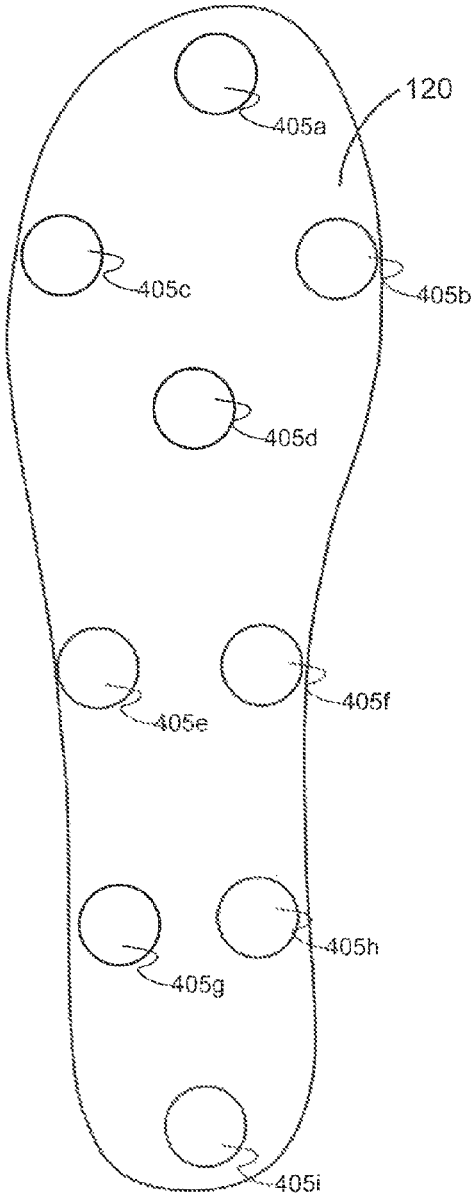
FIGS. 4A and 4B are block diagrams illustrating foot enclosures, in accordance with further embodiments of the present invention.
Figure 4B:
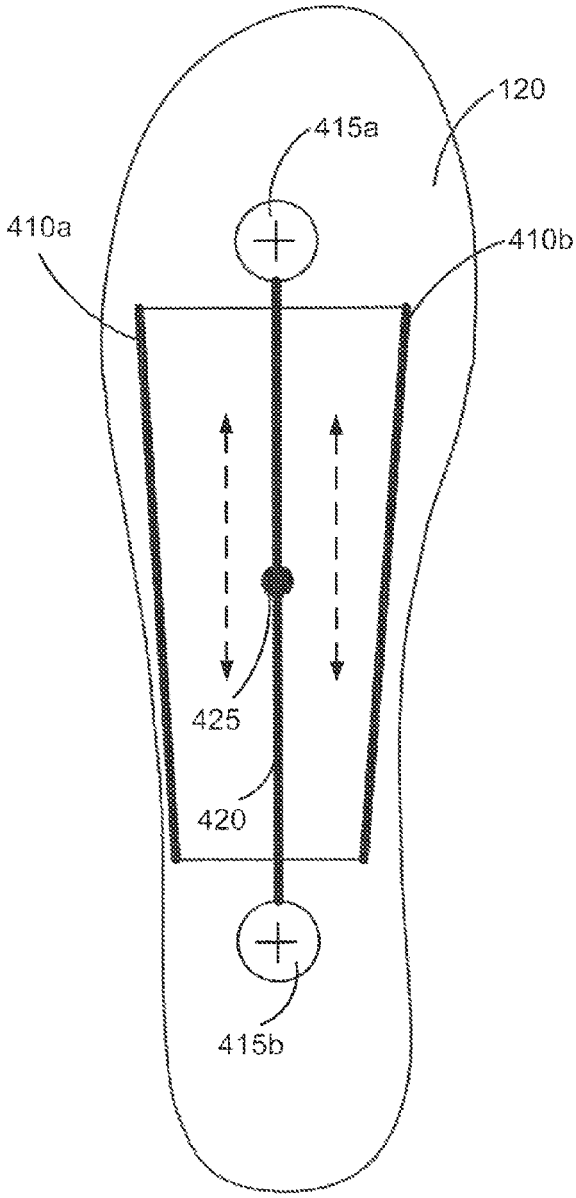

Turning now to FIGS. 4A and 4B, which illustrates embodiments of foot enclosures 120. In one embodiment, foot enclosures 120 may include contact points 405*a*-405*i*, which may be configured to provide low-friction contact between foot enclosures 120 and platform base 105. Contact points 405*a*-405*i* may be placed in any configuration and the number of contact points may be increased or decreased. The material used for contact points 405 may be a low friction material, such as felt, rubber, plastic, or other similar low friction materials may also be configured in a variety of ways. For example, contact points 405 may be configured in such a way as to provide support for the user, alternatively may be configured to optimize the exercise capability of omni-directional exercise device 100.

Referring now to FIG. 4B, which includes support bars 410*a* and 410*b*, mounts 415*a* and 415*b*, and adjustment mechanisms 420 and 425. In one embodiment, support bars 410*a* and 410*b* may be used to provide support to the user's feet, as well as provide balance for the user. Mounts 415*a* and 415*b* may be configured to lock in adjustment mechanism 420 and 425. In one embodiment, adjustment mechanisms 420 and 425 may provide a sliding size adjustment for foot enclosures 120, in order to accommodate for varying foot sizes.

Figure 5A:
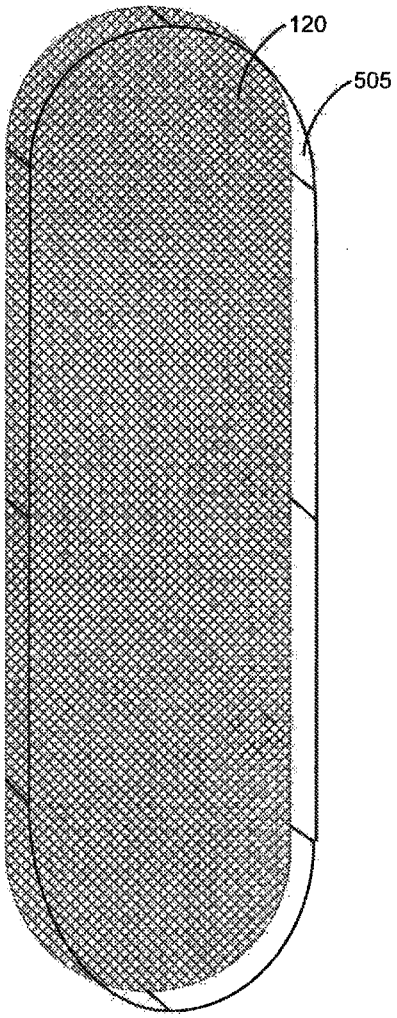
FIGS. 5A and 5B are block diagrams illustrating foot enclosures, in accordance with yet another embodiment of the present invention.

FIG. 5A further illustrates foot enclosures 120. In a further embodiment, foot enclosures 120 may have a strapless design. Rim 505 may be configured to accommodate the user's foot and eliminate the possibility of the user's foot sliding off of foot enclosures 120. Furthermore, the material used for foot enclosures 120 may be a rubber grip, or the like to provide additional grip and traction. Alternatively, gel-like cells may be used to provide additional grip between the user's foot and foot enclosures 120.

Figure 5B:
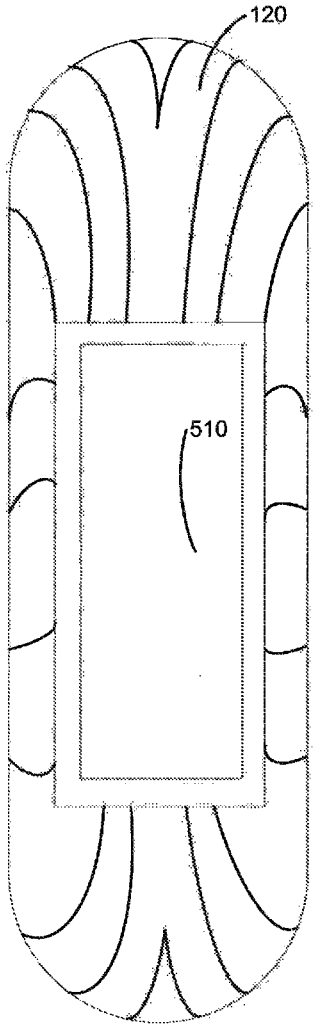

Furthermore, FIG. 5B illustrates an alternative bottom view of foot enclosures 120. As illustrated in FIG. 5B, the bottom portion of foot enclosure 120 may be slightly curved to provide a gradual incline to a central point 510 on foot enclosures 120. As such, foot enclosures 120 are still able to slide along platform base 105 at central point 510, while allowing the user to rock foot enclosures 120 in any direction. As such, the user is able to perform shin, calf, ankle and other similar exercises. For example, the user may be able to rock back onto his or her heel or toe in order to exercise his or her shin and calf muscles. In addition, resistance bands 115 can provide additional resistance for such exercises.

Figure 6A:
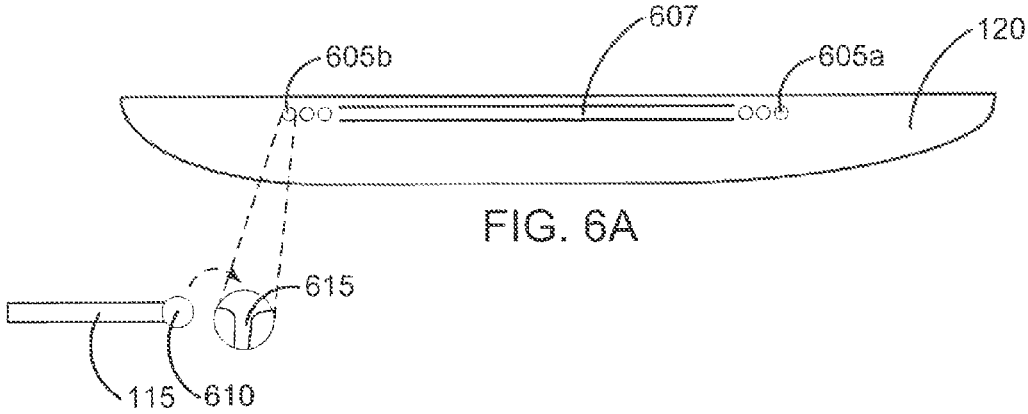
FIGS. 6A, 6B, and 6C are block diagrams illustrating foot enclosures and attachment mechanisms, in accordance with one embodiment of the present invention.
Figure 6B:
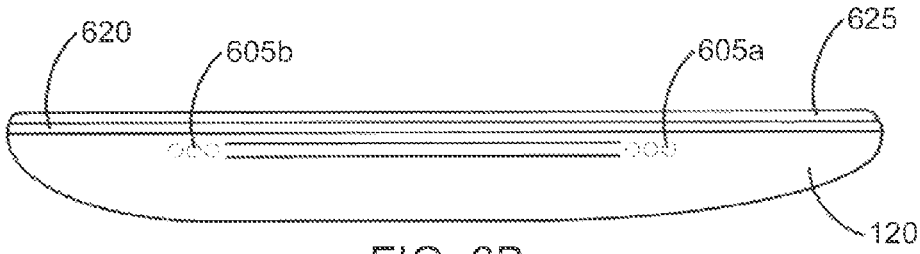

Turning next to FIGS. 6A and 6B, which illustrate attachment mechanisms for attaching resistance bands 115 to foot enclosures 120. In one embodiment, foot enclosures 120 may include a tubular section 607 and attachments points 605*a* and 605*b*. Tubular section 607 may be configured to have resistance bands 115 extend through tubular section 607 in order to adjust the tension strength of resistance bands 115. Further, tubular section 607 is able to house one larger band as opposed to two shorter bands which would each be attached at separate attachment points 605*a* and 605*b*.

Attachment points 605 includes an open cut-out section 615 which provides a lock-in place for a bulbous end 610 of resistance bands 115. In one embodiment, bulbous end 610 locks in behind open cut-out 615, thus locking resistance bands 115 into place.

Figure 6C:
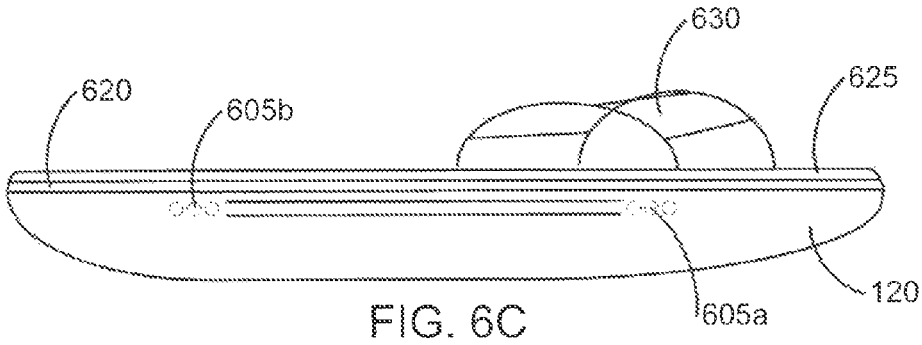

Furthermore, FIG. 6B may include layers 620 and 625 on top of foot enclosures 120. For example, layer 620 may be a semi-soft rubber (or other suitable material) layer, and layer 625 may be a cushion and grip layer configured to provide comfort and support, as well as grip for the user. Furthermore, FIG. 6C illustrates a strap 630 which may be included to provide additional stability for the user.

Figure 7:
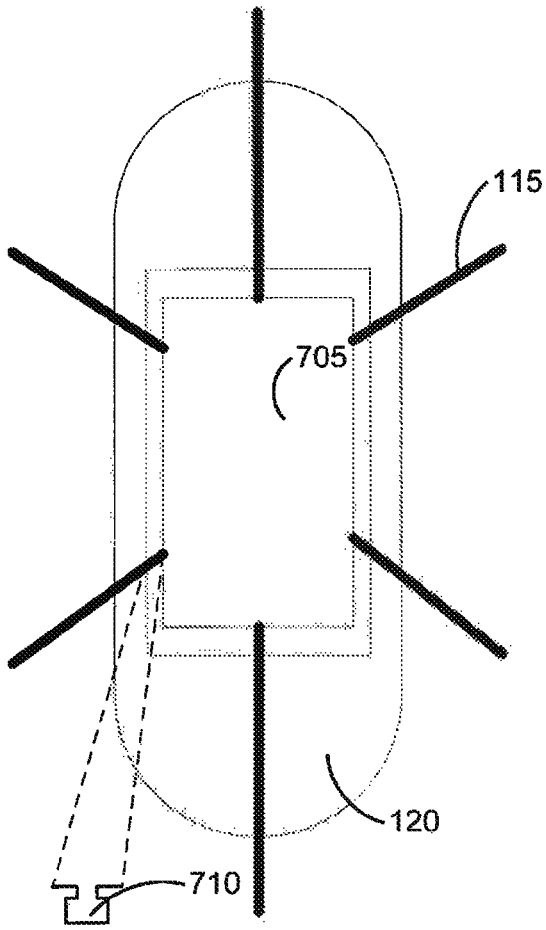
FIG. 7 is a block diagram illustrating attachment mechanisms, in accordance with yet another embodiment of the present invention.

Turning now to FIG. 7, which illustrates an alternative attachment configuration for attaching resistance bands 115 to foot enclosures 120. In one embodiment, resistance bands 115 may be connected at a base 705 at the bottom of foot enclosures 120. Resistance bands 115 may be "notched" in place using a notch 710, as shown in FIG. 7. Nonetheless, alternative notching configurations may be used.

Figure 8:
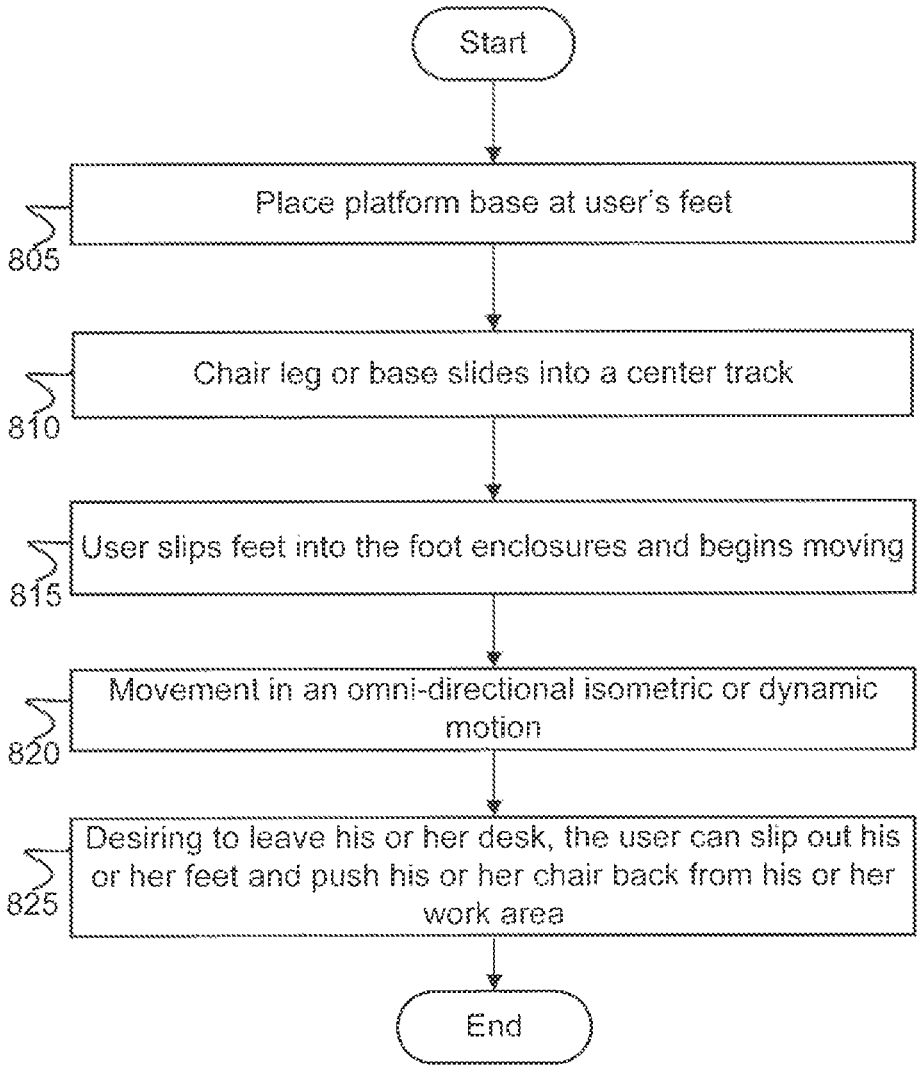
FIG. 8 is a flow diagram illustrating a method of using an omni-directional exercise device, in accordance with another embodiment of the present invention.

Turning next to FIG. 8, which illustrates a method 800 for using omni-directional exercise device 100. At process block 805, the platform base (FIG. 1) is placed at the user's feet. At process block 810, the chair leg or base slides into a center track (FIG. 1) and the device is used with ankles comfortably placed below knees forming a 90-degree angle at home position. At process block 815, the user can slip his or her feet into the foot enclosures (FIG. 1) and begin moving at his or her own pace. Once the user's feet are snugly in the foot enclosures, the user can choose when and how to move. Movements are omni-directional where the feet and legs can move isometrically (static position held) or dynamically (joints and muscles are moving) or perform both movements simultaneously (process block 820). Movement pattern examples include but are not limited to the following: out and in laterally (leg abduction and adduction); forward and back (knee extension and flexion); clockwise and counterclockwise circular patterns (large and small); heel raises; toe raises; changing the angle of the feet whereby the muscles used change as with a toe lift; pivoting motions of toes with the heels stable and vice versa; foot and leg lifts; and/or legs and feet can be moved alternately or simultaneously.

The movement patterns are chosen by the user allowing them to customize their activity, moving as much or as little as desired. Most movements may be sustained for short intervals ranging from 30 seconds to a few minutes depending on the exercise and preferences of the user. At process block 825, when the user desires to leave his or her desk, he or she can slip his or her feet out without any adjustments; push his or her chair back from his or her work area where the caster rolls back on the track. When the user returns to his or her desk, he or she rolls forward with the caster in the track, assumes a comfortable and good posture and resumes the movement activity of his or her choice.

Furthermore, initial set up consists of adjusting the foot enclosure to a user's foot size using a slider mechanism that sits under the foot bed (FIG. 4B), then choosing the preferred tension of the resistance bands (extra light, light, medium or heavy, etc.), and then attaching the resistance bands to the foot enclosures and corresponding attachment points on the platform base.

Figure 9A:
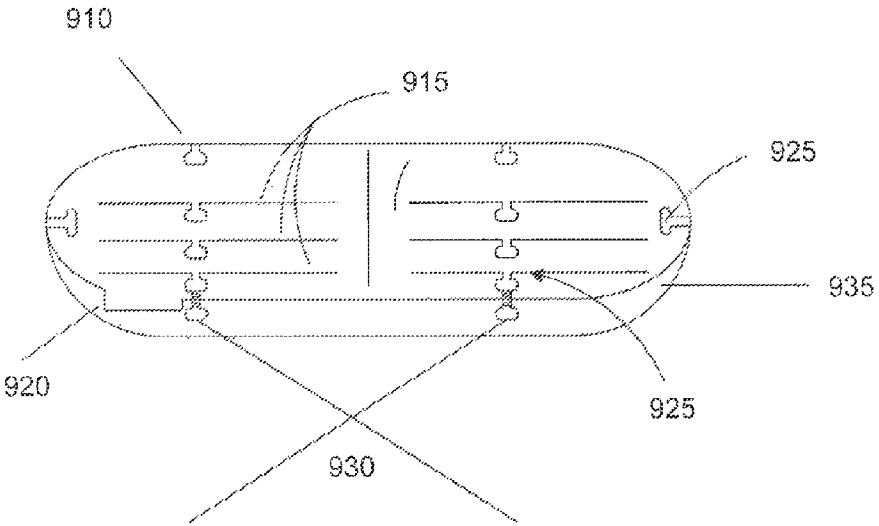
FIGS. 9A and 9B are block diagrams illustrating a top and bottom portion of an interlocking enclosure, in accordance with yet another embodiment of the present invention.
Figure 9B:
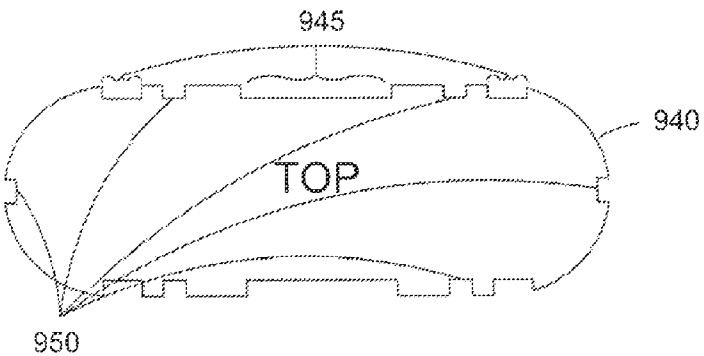

Turning now to FIGS. 9A and 9B, which illustrate a top portion and bottom portion of an interlocking enclosure, in accordance with yet another embodiment of the present invention. The bottom portion 910 of the foot bed enclosure illustrated in FIG. 9A includes structural ribs or supports 915 running along a part of a base 920 (e.g., made of plastic). Also, included are several attachment points 925 for attaching a resistance band 930. In some embodiments, attachment points 925 can be placed along the edges of bottom portion 910 or inside the base wall 935. By attaching the bands to different attachment points 925, the tension can be adjusted. In some embodiments, the heel and toe portion can include multiple attachment points 925 (e.g., 2 or 3 attachment points each) allowing for an 'X' pattern to be created with the bands. The top portion 940 illustrated in FIG. 9B can include slat openings 945 for a foot/hand strap along with slat opening 950 for the resistance bands 940. In one embodiment, the top portion 940 can be made from a softer plastic and/or rubber material to increase comfort.

Figure 10:
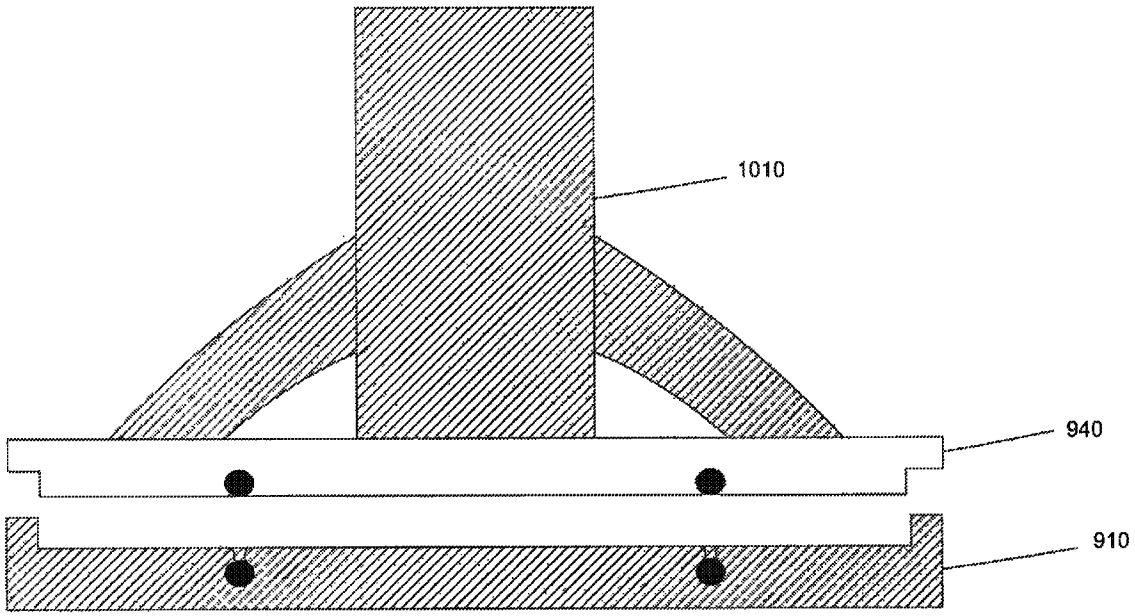
FIG. 10 is a block diagram illustrating a side view of an interlocking enclosure, in accordance with yet another embodiment of the present invention.

FIG. 10 illustrates a side view of an interlocking enclosure with top portion 940 and bottom portion (or base) 910, in accordance with one embodiment of the present invention. In accordance with various embodiments, top portion 940 and bottom portion 910 are designed to form an interlocking structure (e.g., with a snap fit design, with screws, or other locking mechanism) to secure strap 1010 and form an enclosure. In one embodiment, the user can interchange different straps, top portions, and/or bottom portions for form enclosures with different properties.

Figure 11:
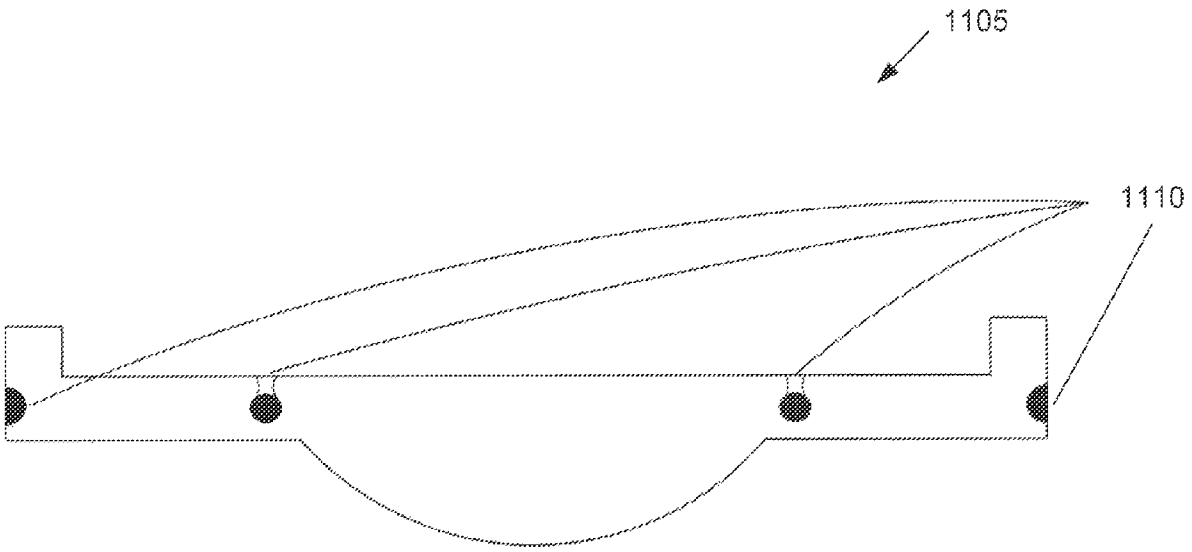
FIG. 11 is a block diagram illustrating a side view of a bottom portion of a foot enclosure that can be used for ankle rehabilitation, in accordance with another embodiment of the present invention.
Figure 12A:
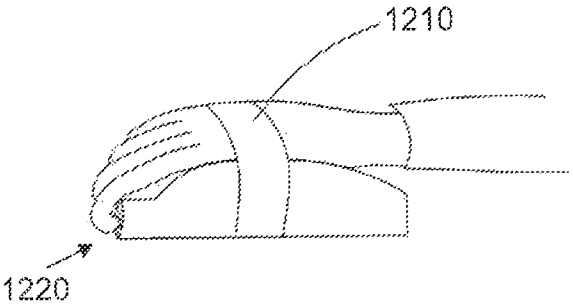
FIGS. 12A and 12B illustrate a side view and a top view of a hand enclosure, in accordance with another embodiment of the present invention.
Figure 12B:
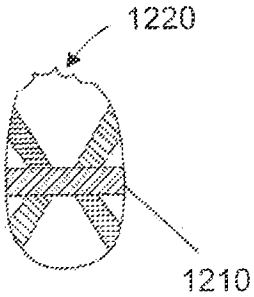

FIG. 11 illustrates a side view of a bottom portion 1105 of a foot enclosure with tube opening 1110 that can be used for ankle rehabilitation, in accordance with another embodiment of the present invention. As another example, different straps, top portions, and/or bottom portions may include different materials, attachment points, and/or other components (e.g., gyroscopes, accelerometers, encoders, calorie estimation modules, wireless communication transmitters/receivers, processors, memories, and/or other devices, modules, and/or components). FIGS. 12A and 12B illustrate a side view and a top view of a hand enclosure, in accordance with another embodiment of the present invention. In one embodiment, enclosure 1210 can include notches formed to receive fingers of a user, a strap 1220 (e.g., with Velcro) to secure the hand to the enclosure, and possibly foam cushioning for a comfort grip. The hand enclosure may be useful, for example, for stroke rehabilitation.

Figure 13:
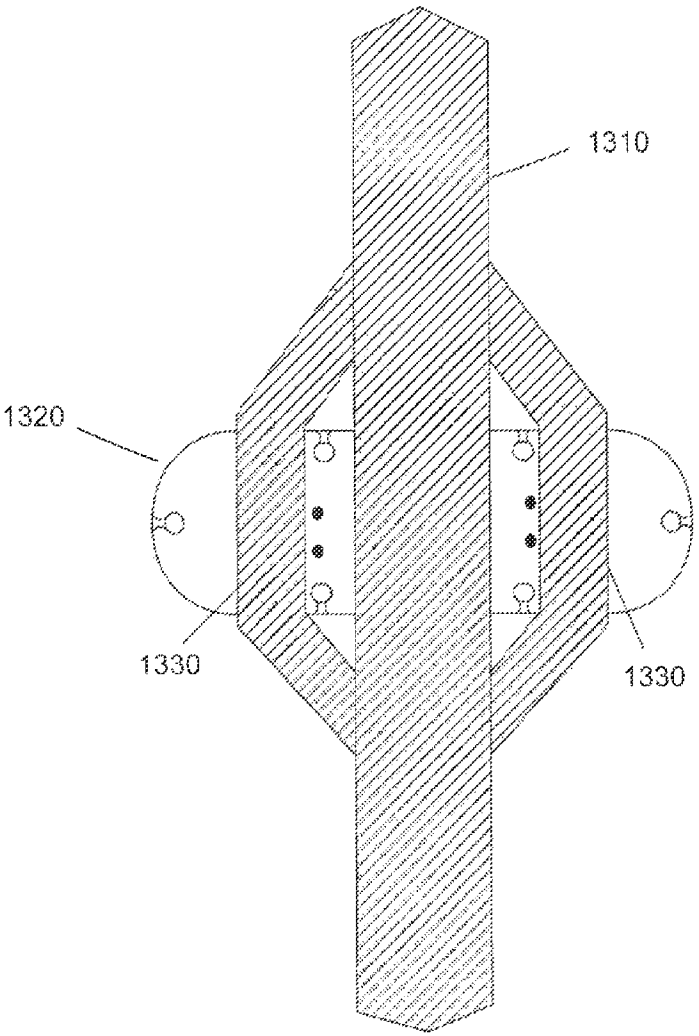
FIG. 13 illustrates an omni-directional exercise device with a strap design, in accordance with another embodiment of the present invention.

In accordance with various embodiments, the enclosure(s) of the omni-directional exercise device can have different mechanisms and designs for securing the enclosure to the user. For example, FIG. 13 illustrates an omni-directional exercise device with a one-piece strap design. FIG. 13 shows a strap 1310 and base portion 1320 with corresponding grooves 1330 to receive the strap. In other embodiments, the strap design may include two or more pieces. In one embodiment, a number of fasteners (e.g., twelve or twenty-four) may be used to secure the strap to base portion 1320.

Figure 14:
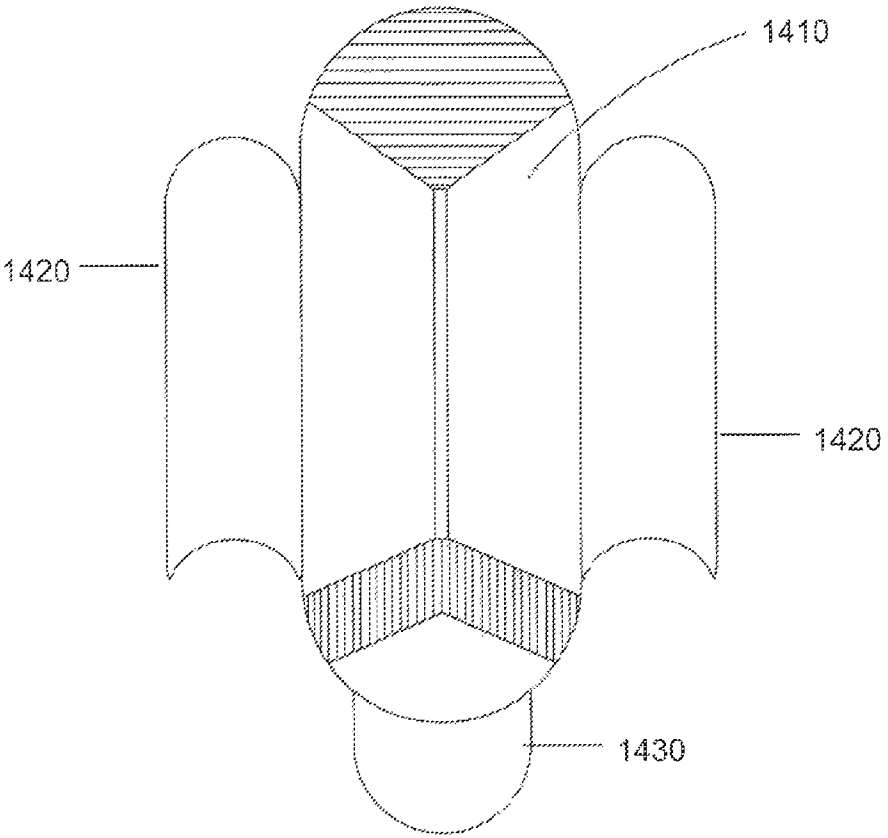
FIG. 14 illustrates an omni-directional exercise device with an automatic enclosing mechanism, in accordance with another embodiment of the present invention.

FIG. 14 illustrates an omni-directional exercise device with an automatic enclosing mechanism, in accordance with another embodiment of the present invention. As such, in response to a user applying pressure to platform 1410 the top side pieces 1420 clamp around the foot or hand of the user. In one embodiment, an end piece 1430 may also engage the user (e.g., the user's heel) along with the top side pieces 1420. In some embodiments, to release the automatic enclosing mechanism, a combination of moves may be used (e.g., hit interior, exterior side, and heel back). This automatic enclosing mechanism may be beneficial for users who have trouble reaching their feet (e.g., the obese) or users that lack the dexterity to close a strap. In some cases, the automatic enclosing mechanism may be part of the two piece interlocking design and can have an interchangeable bottom portion.

Figure 15A:
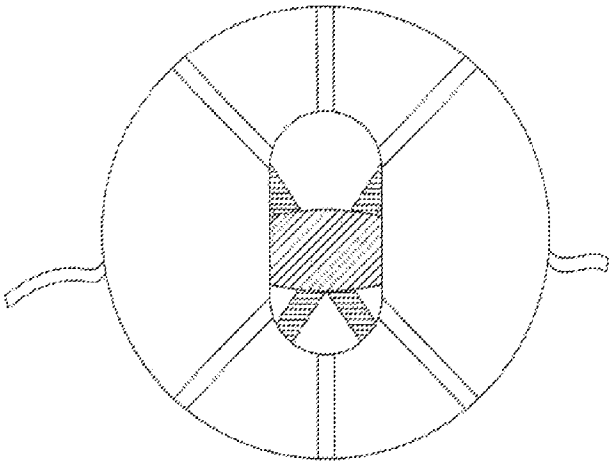
FIGS. 15A and 15B illustrate an omni-directional exercise device, in accordance with another embodiment of the present invention.
Figure 15B:
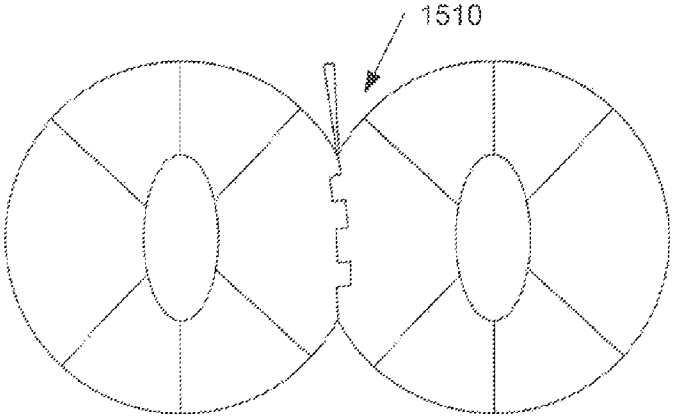

Referring now to FIG. 15B, which illustrate an omni-directional exercise device, in accordance with another embodiment of the present invention. FIG. 15A shows an omni-directional exercise device with a single enclosure. In one embodiment, the base platform may include a connection mechanism for coupling one base platform to another. Examples include a lock pin system 1510 as illustrated in FIG. 15B, magnets, Velcro, snap fit interlocking design, and others. One advantage of the single enclosure exercise device is the compact design. Another advantage is the emotional and physical benefits of having a single enclosure present for an amputee. In addition, this design allows for an isolated movement of each limb. In some embodiments, multiple bands can be attached to the enclosure (e.g., along the toe portion, the heel portion, and/or sides of the enclosure). The enclosure can have multiple connection points to allow the bands to attach at different points. In one embodiment, the bands can be crossed creating an 'X' pattern between the enclosure attachment points and the attachment points on the platform base.

Figure 16:
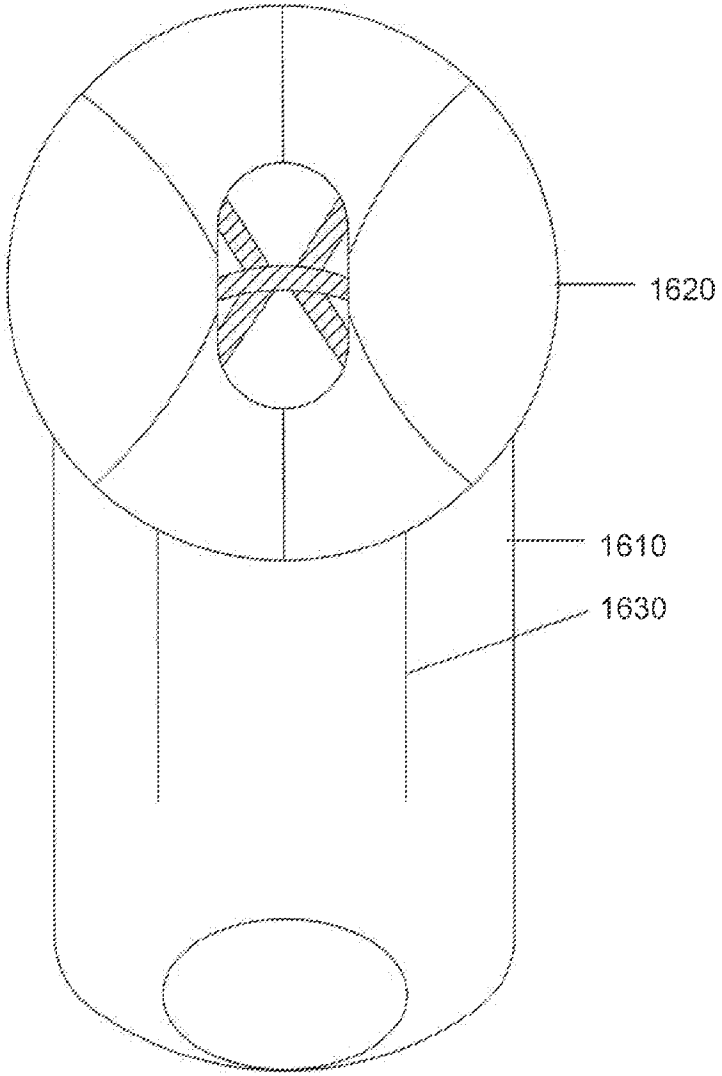
FIG. 16 illustrates omni-directional exercise device with a single enclosure and a sliding mechanism in accordance with other embodiments of the present invention.
Figure 17:
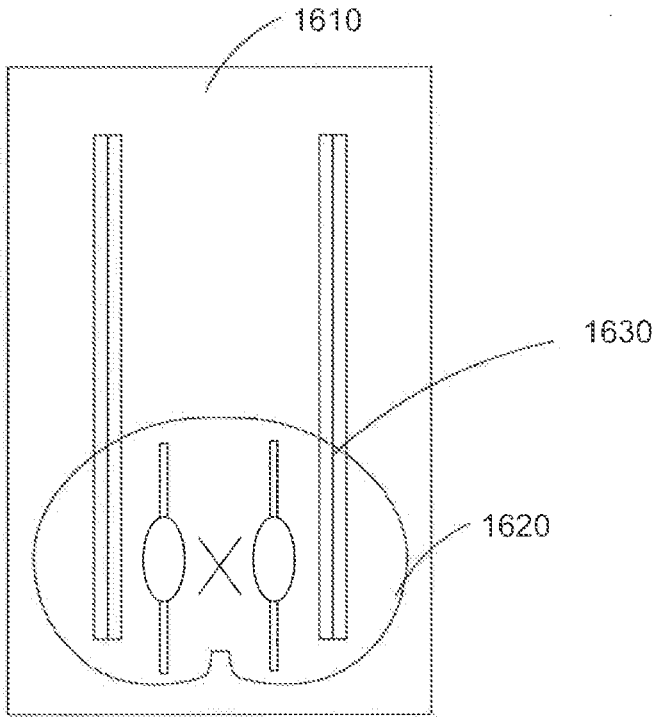
FIG. 17 illustrates omni-directional exercise device with two enclosures and a sliding mechanism according to another embodiment of the present invention.

Turning now to FIGS. 16 and 17, which illustrate an omni-directional exercise device with a single and double enclosure along with a sliding mechanism in accordance with other embodiments of the present invention. A platform base extender 1610 can be attached to the platform base in some embodiments. The user can slide the platform base 1620 along the platform base extender 1610 guided by a sliding mechanism 1630. This allows for greater leg extension without moving from a seated position and allows for a change in the muscular engagement (e.g., the muscles around the hips). The platform base extender 1610, in one embodiment, can be designed to be positioned underneath or around a chair.

Figure 18:
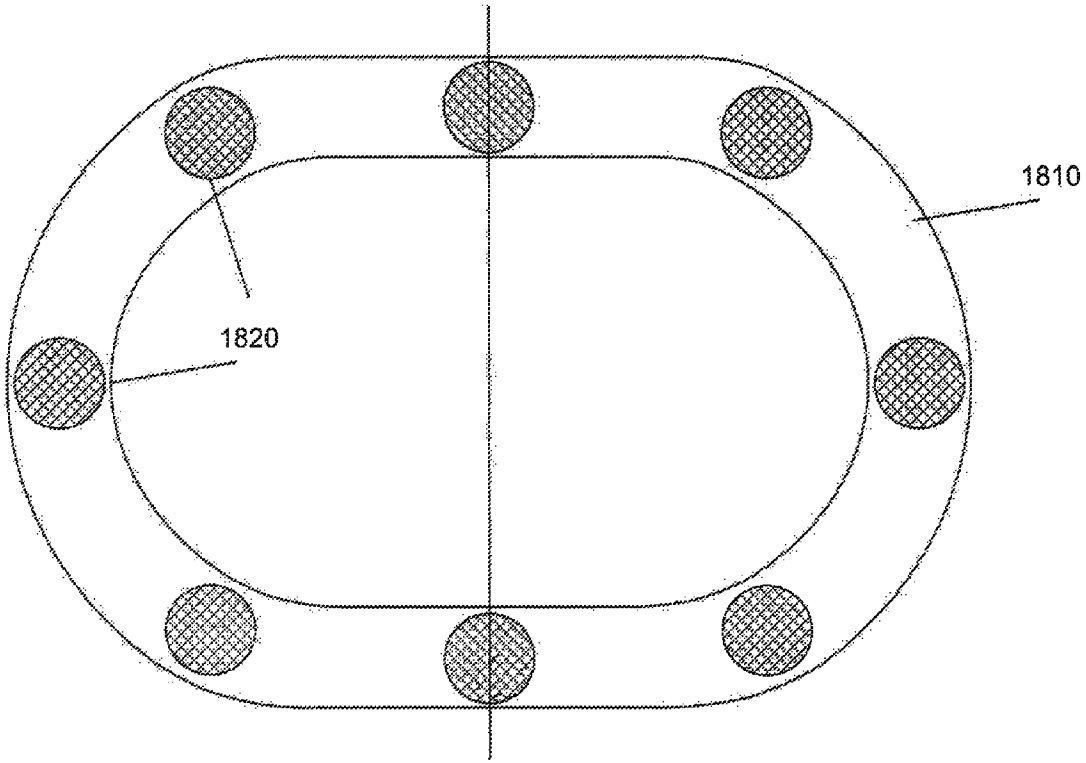
FIG. 18 illustrates a platform base that can be used with an omni-directional exercise device in accordance with another embodiment of the present invention.

Referring now to FIG. 18, which illustrates a platform base that can be used with an omni-directional exercise device in accordance with another embodiment of the present invention. The platform 1810 illustrated in FIG. 18 has one or more anti-slip pads 1820 placed around the base. In some embodiments, the platform base 1810 can be used in conjunction with risers, incline boards, or legs to raise the entire platform and/or elevate one side over another to create an angle (e.g. for stretching calves or shins) In some cases, the platform can also include one or more attachment mechanisms for attaching the platform to a wheelchair or other object (e.g., power plate equipment).

Figure 19:
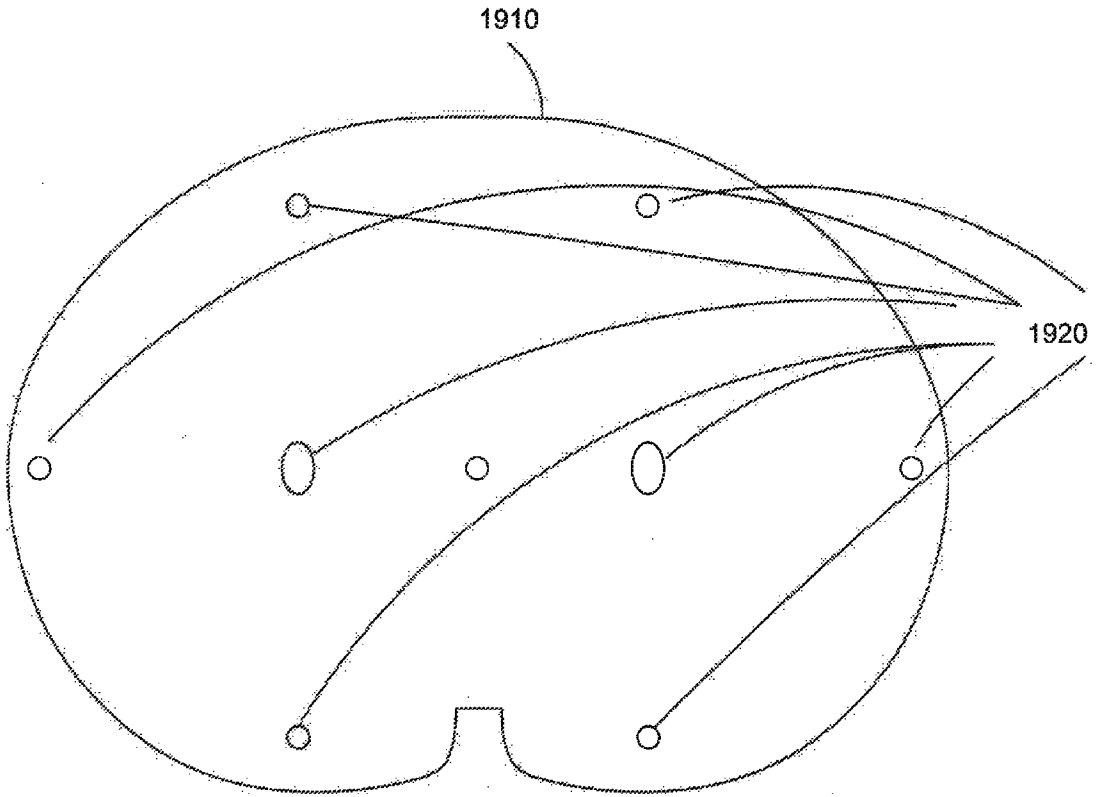
FIG. 19 illustrates a platform base that can be used with an omni-directional exercise device in accordance with another embodiment of the present invention.

Now turning to FIG. 19, which illustrates a platform base 1910 that can be used with an omni-directional exercise device in accordance with another embodiment of the present invention. The embodiment illustrated here uses magnets 1920 (or other mechanisms for creating a magnetic field) to create a resistance for the enclosures that slide on top. In some embodiments, various components are used to detect in real-time the position, velocity, and/or acceleration of the enclosures and change the magnetic field to create a desired resistance level at each point in the user's movement.

Exemplary Computer System Overview

Figure 20:
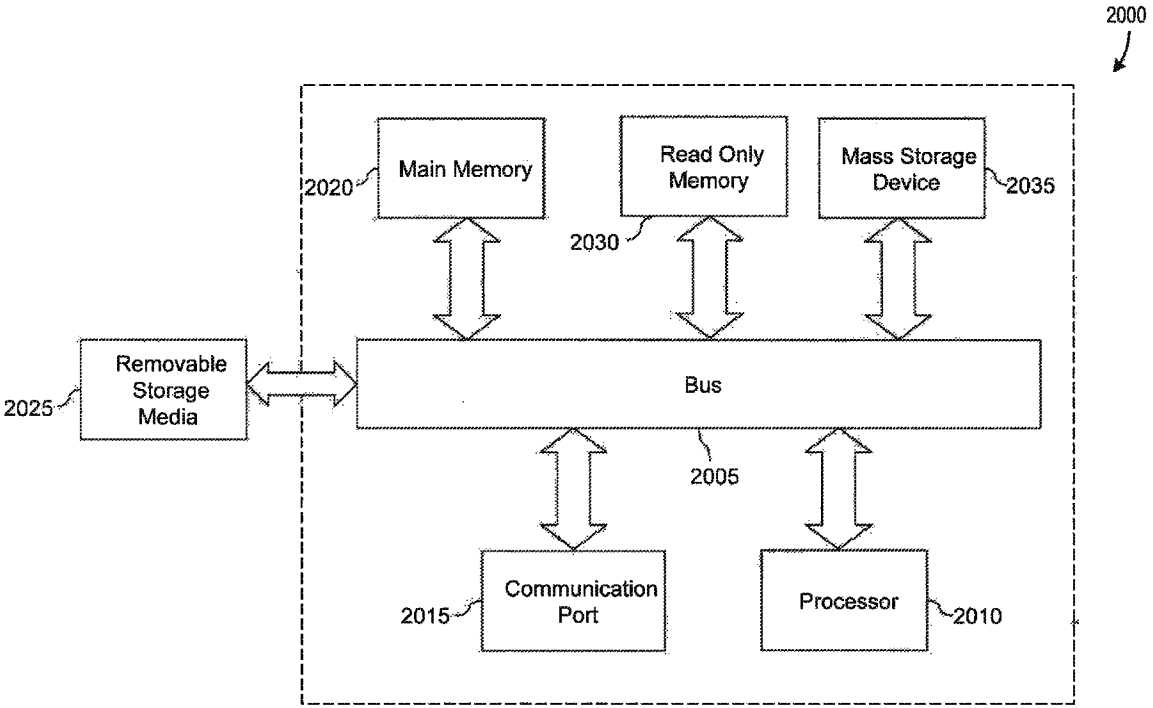
FIG. 20 illustrates an example of a computer system with which some embodiments of the present invention may be utilized.

Embodiments of the present invention include various steps and operations, which have been described above. A variety of these steps and operations may be performed by hardware components or may be embodied in machine-executable instructions, which may be used to cause a general-purpose or special-purpose processor programmed with the instructions to perform the steps. Alternatively, the steps may be performed by a combination of hardware, software, and/or firmware. As such, FIG. 20 is an example of a computer system 2000 with which embodiments of the present invention may be utilized. The computer system may be integrated into the exercise device or communicably coupled through a wireless communications device. The computer may be used for tracking, recording, monitoring, reporting, and making recommendations to the user. In one embodiment, graphical user interface screens can be used by a user/patient and a doctor for the delivery and reporting of treatment regimes. According to the present example, the computer system includes a bus 2005, at least one processor 2010, at least one communication port 2015, a main memory 2020, a removable storage media 2025, a read only memory 2030, and a mass storage 2035.

Processor(s) 2010 can be any known processor, such as, but not limited to, an Intel® Itanium® or 2® Itanium processor(s), or AMD®, Opteron® or Athlon MP® processor(s), or Motorola® lines of processors. Communication port(s) 2015 can be any of an RS-232 port for use with a modem-based dialup connection, a 10/100 Ethernet port, or a Gigabit port using copper or fiber optic cable. Communication port(s) 2015 may be chosen depending on a network such a Local Area Network (LAN), Wide Area Network (WAN), or any network to which the computer system 2000 connects.

Main memory 2020 can be Random Access Memory (RAM), or any other dynamic storage device(s) commonly known in the art. Read only memory 2030 can be any static storage device(s) such as Programmable Read Only Memory (PROM) chips for storing static information such as instructions for processor 2010.

Mass storage 2035 can be used to store information and instructions. For example, hard disks such as the Adaptec® family of SCSI drives, an optical disc, an array of disks such as the Adaptec® family of RAID drives, or any other mass storage devices may be used.

Bus 2005 communicatively couples processor(s) 2010 with the other memory, storage and communication blocks. Bus 2005 can be a PCI/PCI-X or SCSI based system bus depending on the storage devices used.

Removable storage media 2025 can be any kind of external hard-drives, floppy drives, IOMEGA® Zip Drives, Compact Disc-Read Only Memory (CD-ROM), Compact Disc-Re-Writable (CD-RW), Digital Video Disk-Read Only Memory (DVD-ROM).

The components described above are meant to exemplify some types of possibilities. In no way should the aforementioned examples limit the scope of the invention, as they are only exemplary embodiments.

While the invention has been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods of the invention are not limited to any particular structural and/or functional architecture but instead can be implemented on any suitable hardware, firmware, and/or software configuration. Similarly, while various functionalities are ascribed to certain system components, unless the context dictates otherwise, this functionality can be distributed among various other system components in accordance with different embodiments of the invention.

Moreover, while the procedures comprised in the methods and processes described herein are described in a particular order for ease of description, unless the context dictates otherwise, various procedures may be reordered, added, and/or omitted in accordance with various embodiments of the invention. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary features, the various components and/or features described herein with respect to a particular embodiment can be substituted, added and/or subtracted from among other described embodiments, unless the context dictates otherwise. Consequently, although the invention has been described with respect to exemplary embodiments, it will be appreciated that the invention is intended to cover all modifications and equivalents within the scope of the following claims.

What is claimed is:

1. An omni-directional exercise device comprising:

a platform base;

a resistance mechanism coupled to the platform base; and an enclosure positioned on top of the platform base at a home position and configured to slide within a plane on top of the platform base, wherein the resistance mechanism provides resistance at any point on the platform base and is configured to return the enclosure to the home position.

2. The omni-directional exercise device as in claim 1, wherein the resistance mechanism includes a plurality of resistance bands or a set of magnets.

3. The omni-directional exercise device as in claim 1, wherein the platform base includes a means for coupling the platform base to a second platform base.

4. The omni-directional exercise device as in claim 1, wherein the enclosure includes an accelerometer to measure accelerations of the enclosure.

5. The omni-directional exercise device as in claim 4, wherein the omni-directional exercise device includes a calorie module to receive a signal generated by the accelerometer and to estimate a caloric burn or a step equivalent based on the signal.

6. The omni-directional exercise device as in claim 5, wherein the omni-directional exercise device includes a wireless interface to transmit the signal from the accelerometer to the calorie module.

7. The omni-directional exercise device as in claim 1, wherein the enclosure includes a structurally ribbed base plate and a top plate having one or more slots for securing a strap.

8. An omni-directional exercise device comprising:

a platform base having a plurality of target indicators capable of being activated by a processor in one or more patterns;

a plurality of resistance bands coupled to the platform base; and an enclosure coupled to the plurality of resistance bands, wherein the enclosure is positioned on top of the platform base, and wherein the enclosure is configured to be moved by a user in any direction along the top of the platform base toward an activated target indicator.

9. The omni-directional exercise device as in claim 8, wherein the enclosure is a first enclosure and the omni-directional exercise device includes a second enclosure coupled to the first enclosure and the platform base by a subset of the plurality of resistance bands.

10. The omni-directional exercise device as in claim 8, wherein the enclosure includes a means for determining the position of the enclosure in relation to the platform base.

11. The omni-directional exercise device as in claim 8, wherein the enclosure includes one or more of a positional encoder, an accelerometer, or a gyroscope.

12. The omni-directional exercise device as in claim 11, further comprising a movement module to generate the one or more patterns of the plurality of target indicators and to record the movements of the enclosure relative to the platform base.

13. The omni-directional exercise device as in claim 8, wherein the enclosure includes at least two layers which are interchangeable by the user.

14. The omni-directional exercise device as in claim 8, wherein the enclosure includes a bottom layer that allows for angular rotation of the enclosure.

15. An omni-directional exercise device comprising:

a platform base;

a plurality of resistance bands coupled to the platform base; and an enclosure coupled to the plurality of resistance bands, wherein the enclosure is positioned on top of the platform base and is configured to slide in a plane parallel to the top of the platform base and to rotate about each axis in the plane and about an axis perpendicular to the plane such that the plurality of resistance bands provide resistance at any point on the platform base.

16. The omni-directional exercise device as in claim 15, wherein the enclosure includes a rounded bottom plate to allow the enclosure to rotate about each axis in the plane and about the axis perpendicular to the plane.

17. The omni-directional exercise device as in claim 15, wherein the enclosure includes a top plate with lateral appendices, wherein the lateral appendices are configured to automatically close in response to pressure being applied to the top plate.

18. The omni-directional exercise device as in claim 15, wherein the enclosure includes a top plate and a strap attached to the top plate, wherein the strap can be used to secure the enclosure to a user.

19. The omni-directional exercise device as in claim 15, wherein the platform base includes a sliding mechanism configured to extend and retract a portion to platform base.

20. The omni-directional exercise device as in claim 15, wherein the platform base includes risers to raise one or more sides of the platform base.

* * * * *